US005846034A

United States Patent [19]

Martin et al.

[11] Patent Number: 5,846,034

[45] Date of Patent: Dec. 8, 1998

[54] AUTOMATED DRILL STEM GUIDE AND METHOD

[75] Inventors: Samuel A. Martin, Sugarland; Leslie P. Antalffy, Houston; Michael B. Knowles, Missouri City; William R. Sines, Houston, all of Tex.

[73] Assignee: Fluor Corporation, Irvine, Calif.

[21] Appl. No.: 672,270

[22] Filed: Jun. 26, 1996

[51] Int. Cl.[6] ..... B23B 35/00; C21B 3/00

[52] U.S. Cl. ..... 408/1 R; 266/45; 266/271; 408/80

[58] Field of Search ..... 175/220; 408/1 R, 408/79, 80, 81, 103, 110, 115 R, 115 B; 266/44, 45, 271, 272

[56] References Cited

U.S. PATENT DOCUMENTS

| | | | |
|---|---|---|---|
| 2,705,630 | 4/1955 | Taddeo | 266/271 |
| 3,700,347 | 10/1972 | Nanne et al. | 266/271 |
| 4,201,502 | 5/1980 | Skendrovic | 408/205 |
| 5,022,799 | 6/1991 | Torres et al. | 408/1 |

FOREIGN PATENT DOCUMENTS

| | | | |
|---|---|---|---|
| 054 | 1/1976 | Japan | 266/271 |
| 63630 | 6/1941 | Norway | 408/80 |

*Primary Examiner*—Daniel W. Howell
*Attorney, Agent, or Firm*—Robert D. Fish; Crockett & Fish

[57] ABSTRACT

In a petroleum coking drum, a drill stem guide latches internally to a structure adjacent the drum opening, rather than externally to a flange about the drum opening. In preferred embodiments, the latching mechanism is spring loaded, and operated automatically as a function of raising and lowering the guide.

15 Claims, 5 Drawing Sheets

AUTOMATED DRILL STEM GUIDE AND METHOD

I. FIELD OF THE INVENTION

The present invention relates to the field of coking drums.

II. BACKGROUND OF THE INVENTION

The petroleum industry uses "delayed cokers" to produce coke from high boiling (greater than 425° C.) petroleum fractions. The process takes place in large drums, sometimes measuring 8 meters across and several stories high. In a typical operation the high boiling hydrocarbons are fed as a liquid into a coke drum, and heated within the coke drum to approximately 450° C. to thermally crack the molecules. The thermal cracking produces smaller molecules which are recovered from the top of the drum, and larger molecules which remain in the drum to form a solid residue known as petroleum coke. The solid residue is then further treated with steam to remove volatile hydrocarbons, and the steamed residue is then quenched with water. After cooling down to approximately 95° C. the quenched water is drained, the coke drum is opened at both the top and bottom, and the solid product is drilled out for recovery. A typical drilling procedure employs rotating a high pressure water drill mounted on a drill stem.

In the past drill stems have been typically aligned and mounted into position manually. In one such method, the cover (also known as a lid) is removed from the upper opening of the drum, and a two-piece hinged collar is placed at the opening. The drill stem is then fixed into position by clamping the collar to a flange located on the top of the coke drum. While the hinged collar method has been used for many years, it is inherently unsatisfactory. The method usually involves manually aligning and mounting the drill stem, which in turn exposes personnel to the hot top flange and collar, steam, and residual heated hydrocarbons escaping from the steam-treated solid material in the drum. The method is also susceptible to operator error, in that failure to secure the collar to the top flange of the drum may accidentally result in the collar sliding out of engagement due to movement of the drill stem.

A more recent method avoids direct operator contact with the coke drum and associated elements by providing a flange at the upper opening of the coke drum, and applying an automatic clamping mechanism around the flange. This method, however, is problematic in that it requires a top end flange, which may be undesirable or impossible to configure in particular circumstances.

Accordingly, there is still a need for an alternative method of aligning and engaging a drill stem with the upper opening in a coke drum, which eliminates the need for direct operator contact with the coke drum and associated elements, and also eliminates the need for an end flange.

III. SUMMARY OF THE INVENTION

The present invention is directed to a drill stem guide which latches internally to a structure adjacent the drum opening, rather than externally to a flange about the drum opening.

IV. BRIEF DESCRIPTION OF THE DRAWINGS

The present invention will become better understood through a consideration of the following description taken in conjunction with the drawing wherein like numerals represent like components, in which.

V. DETAILED DESCRIPTION

Figure 1:
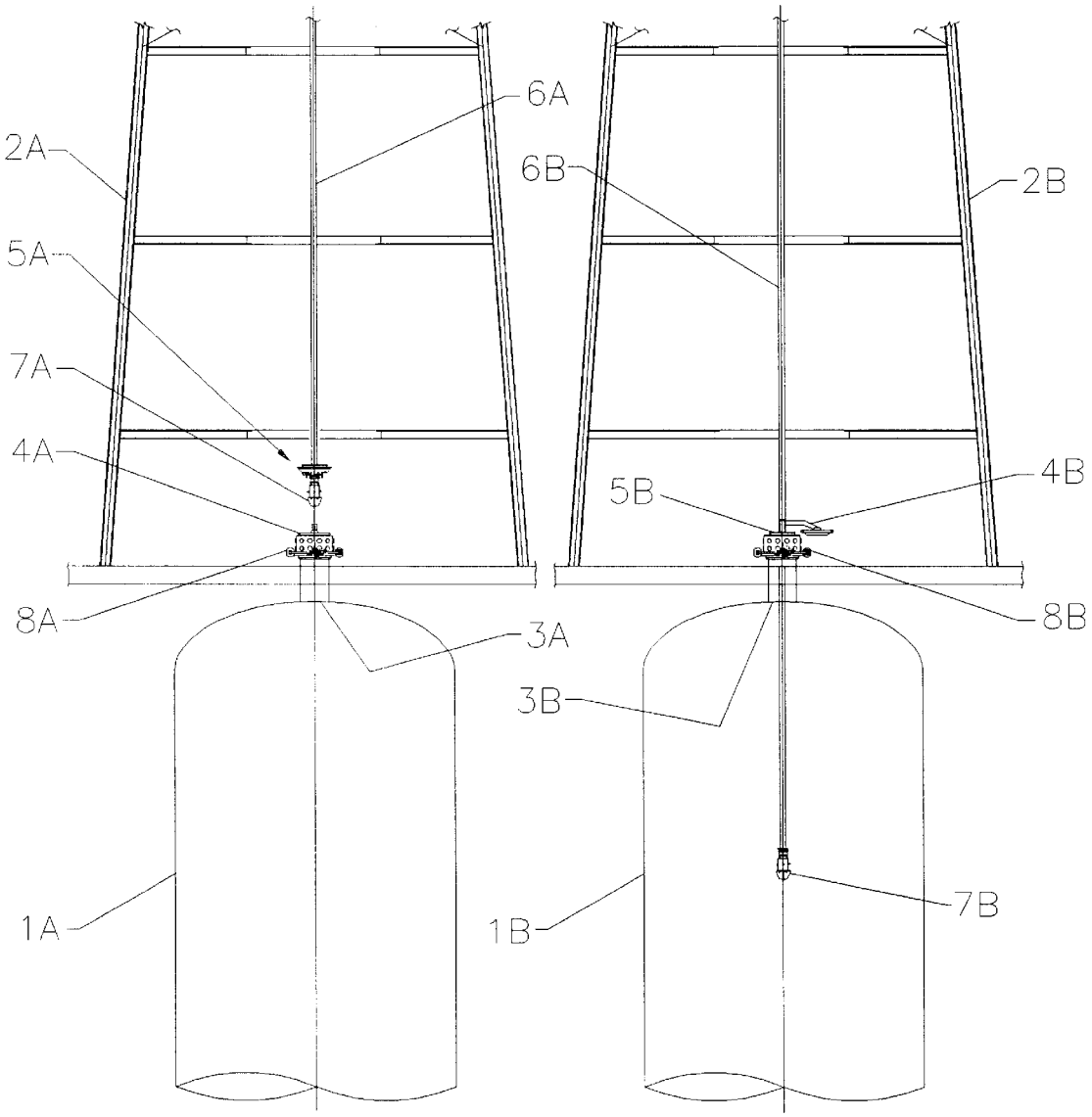
FIG. 1 is a schematic of two different coke drum systems according to the present invention, one drum system in the processing stage and one drum system in the decoking stage.

Turning now to the drawing, FIG. 1 generally depicts first and second coke drums 1A and 1B positioned below their respective coke drilling derricks 2A and 2B. Each of the coke drums 1A, 1B has a generally cylindrical shape, with rounded tops and bottoms. There are openings 3A and 3B near the top of each of the drums through which drilling bits 7A and 7B can be lowered into the respective drums 1A and 1B.

Coke drums are usually operated in out-of-phase pairs as shown, so that one drum can be loaded or unloaded while the other drum is processing coke. In this particular example, coke drum 1A is "in process". The opening 3A at the top of the drum 1A is closed by cover 4A, and drill stem 6A, drill stem guide 5A and cutting bit 7A have all been retracted up into derrick 2A. In contrast, coke drum 1B is being decoked, with cover 4B pulled out of the way. Stem guide 5B has been positioned in opening 3B, and drill bit 7B and a portion of drill stem 6B have been lowered into drum 1B.

Of course, coke drums 1A and 1B may have other openings as well, including lower openings (not shown) through which coke dislodged during the decoking operation can be discharged. Generally speaking, however, the drilling operation takes place from above downward, with the upper opening at or near the apex of the coke drum. Thus, while openings 3A and 3B are shown at the apex of coke drums 1A and 1B, respectively, it should be understood that upper opening is merely relational with respect to other aspects of the drum, such as a lower discharge opening, and upper openings other than those shown in the drawing could be used. In addition, the upper opening may also be considered to be the uppermost portion of whatever upper passageway leads into the drum. Thus, in FIG. 1, the upper opening 3A and 3B may comprise the opening defined by the upper rim of closures 8A and 8B, respectively.

Figure 2:
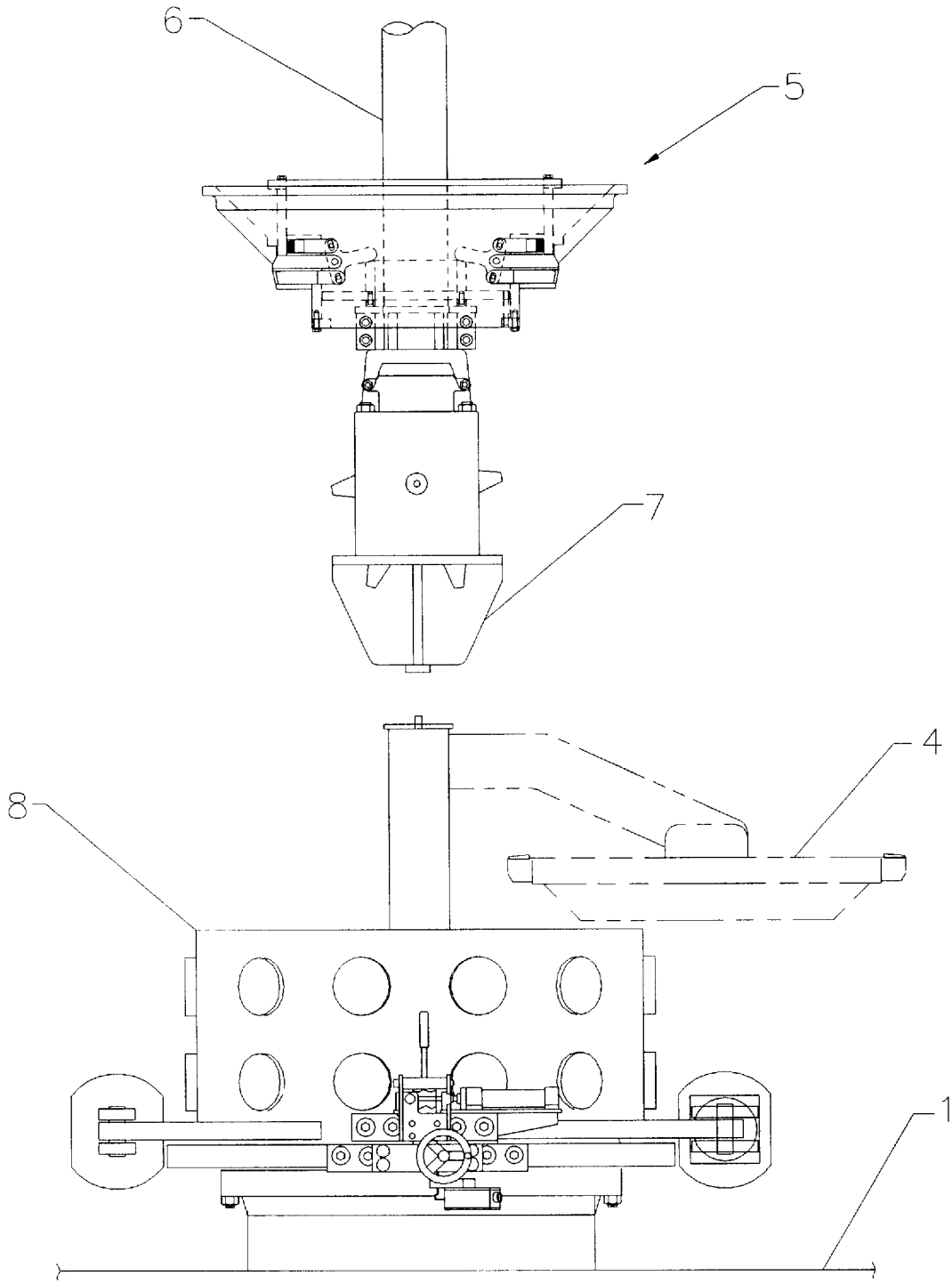
FIG. 2 is a side view of the drill stem guide and closure housing of FIG. 1.

FIG. 2 is an enlarged view of the drill stem guide 5 prior to engagement of the drill stem guide 5 to the closure housing 8. Drill stem 6 and drilling bit 7 are both still positioned above the drum 1. Cover 4 (shown in phantom) is retracted, thereby leaving opening 3 in the open position.

It should be understood that the term "closure housing" is used herein merely to describe a particular structure lying adjacent the passageway from opening 3 into the drum. The generic term used hereinafter for such a structure is a "receiver". Thus, the receivers of alternative embodiments may or may not look similar to the closure housing 8 shown in the drawing, and specifically need not include the various holes depicted in FIGS. 1 and 2. In addition, the term "adjacent" is used herein to mean nearby. It specifically includes adjoining and juxtaposed structures, and the term "adjacent the passageway" includes any object or surface within the passageway. Also, a "catch adjacent the passageway" includes catches projecting from any wall surrounding the passageway, as well as catches projecting into or otherwise defined by such wall or communicating with the passageway through such wall.

Figure 3:
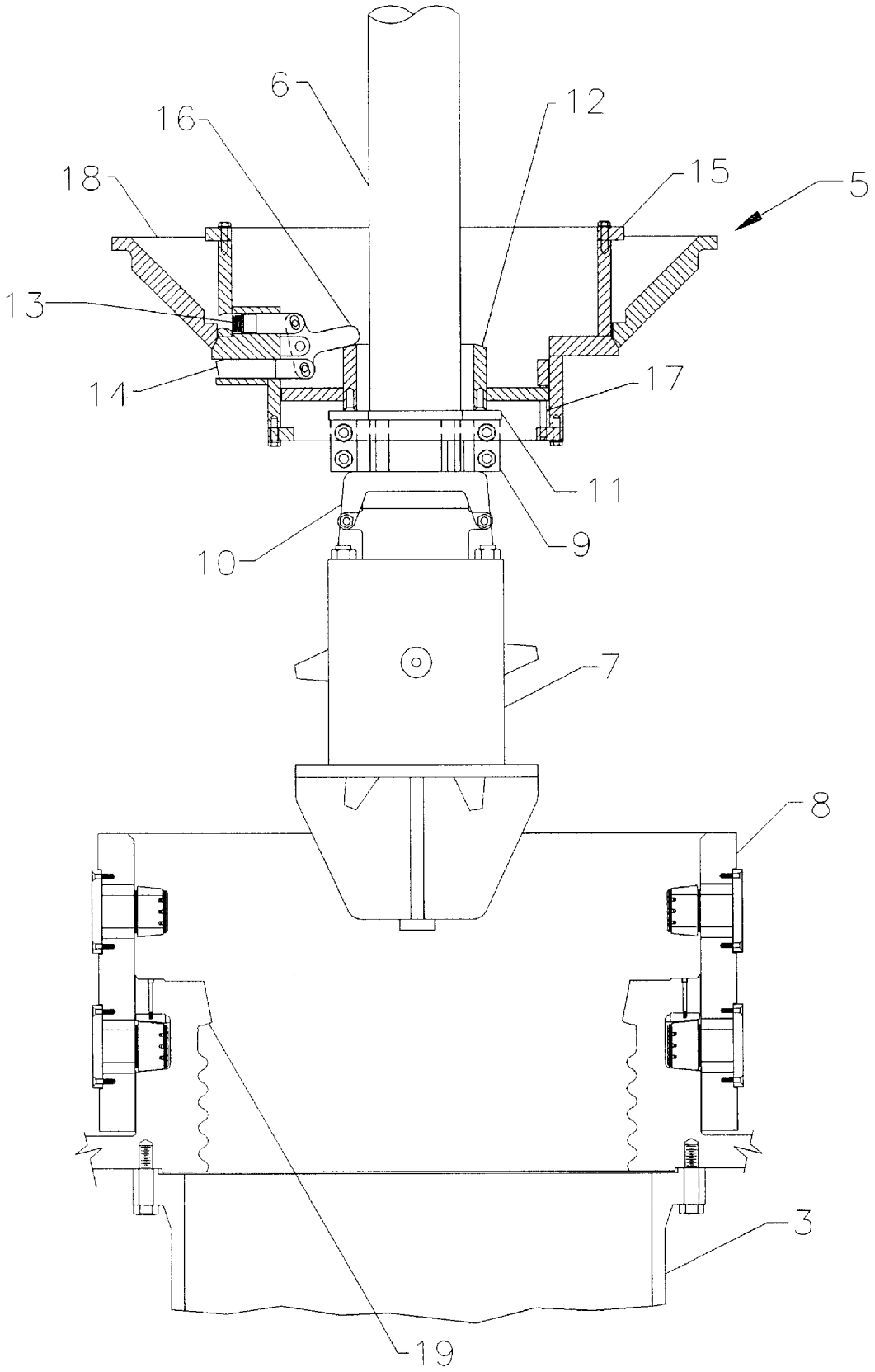
FIG. 3 is a cross-sectional view of the drill stem guide of FIGS. 1 and 2 when disengaged and retracted from the closure housing.

FIG. 3 depicts the attitude and position of the drilling stem guide 5 as it is being lowered into position with respect to opening 3. In this position the drill stem guide 5 is supported on the drill stem 6 by a support clamp 9, which pushes up against collar 12. Collar 12 in turn pushes up against latch actuator 16, thereby retracting latch 14 against the action of spring 13.

Proper positioning of the stem guide 5 within the opening 3 is accomplished at least in part by collar steer pins 17, which prevent rotation between the stem guide collar 12 and the stem guide body 15. A bearing ring 11 between the support clamp 9 and the drill stem 6 positions drill stem 6 and drill bit 7 with respect to the drill stem guide 5 and the opening 3, and further allows drill stem 6 to rotate freely with minimal wear.

Of course, in alternative embodiments the weight of the stem guide 5 may not be employed to actuate latch 14, and for this or other reasons different means from that shown may be used to actuate latch 14. In other embodiments, the latches could extend from a sleeve inserted into the drum opening, with corresponding catches located on the drill stem guide. In still other embodiments, there is no need for latches at all. For example, in one alternative the drum opening could be fitted with a sleeve having a lengthy channel around its internal periphery, and the drill stem guide could have a projection which fits into the channel. In such an embodiment the drill stem guide could be turned about as it is lowered into position, and effectively screwed into the sleeve.

It should also be understood that as used herein, the word "latch" is used in its broadest possible sense to mean any of various devises in which mating mechanical parts engage to fasten, but not necessarily to lock something in place. Thus, latches contemplated herein need not have a latch arm or a "finger" or "hook", and specifically include pivoted bars and threaded or non-threaded bolts which extend into a channel. The word "catch" is similarly to be interpreted broadly herein to include any mechanical part which cooperates with a latch to fasten, but not necessarily to lock something in place. A catch specifically includes a channel or hole into which a threaded or unthreaded bolt can be inserted. The latch may, for example, comprise a large thread, and the corresponding catch may comprise a groove into which the thread is threaded.

One possible way (but not the only way) for a catch to cooperate with a latch is for the catch to receive the latch in some manner. Thus, as used herein, the term "receive" does not necessarily require mating. In FIG. 3, for example, latching ring 19 receives latch 14 even though the latching ring 19 does not mate with latch 14. Similarly, where the latch is a threadless bolt and the catch is a channel, the channel need not have an internal diameter approximately equal to the external diameter of the bolt. A large diameter channel, or a funnel shaped channel, or even perhaps a channel circumscribing the inner surface of the receiver are all contemplated herein as possibilities for receiving the latch.

Also apparent in FIG. 3 is a coupling 10 which allows the drill bit 7 to be coupled to and decoupled from drill stem 6. As depicted in the drawing coupling 10 appears to support the support clamp 9 on a shoulder, but such support is neither necessary nor intended.

Figure 4:
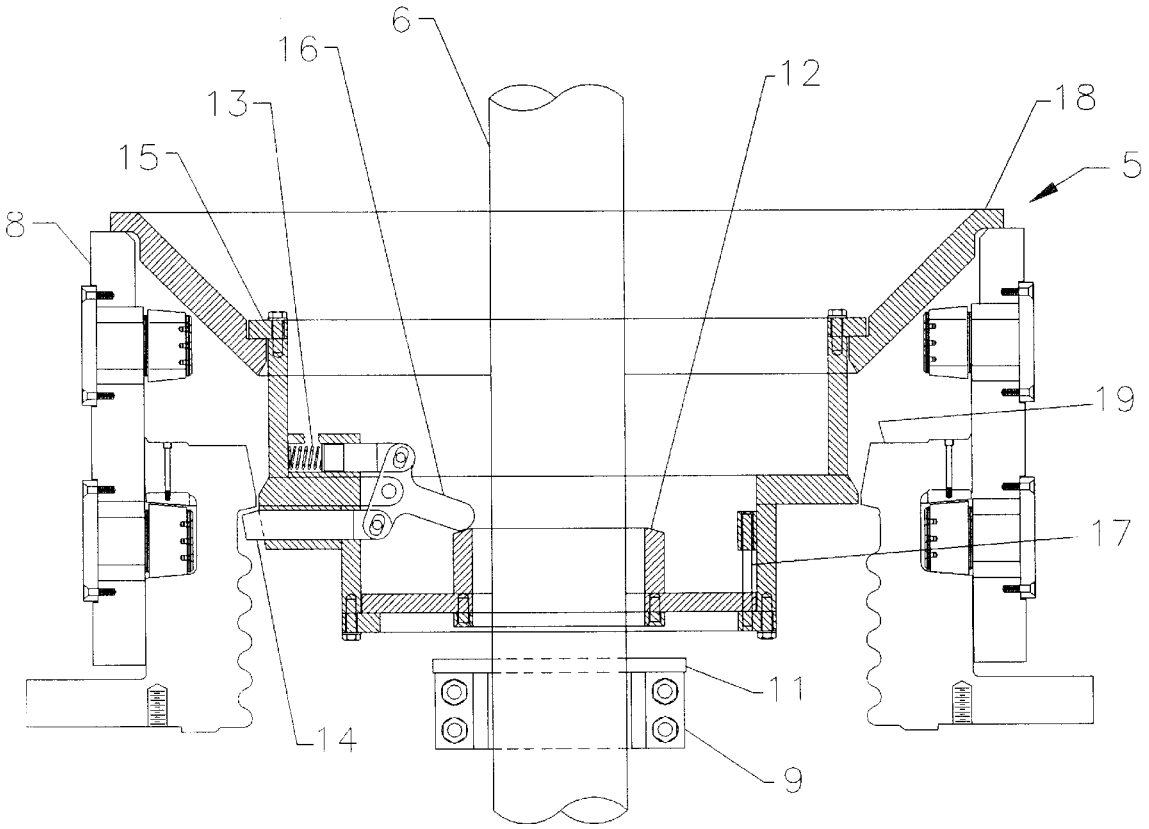
FIG. 4 is a cross-sectional view of the drill stem guide of FIGS. 1 and 2 when engaged with the closure housing.
Figure 5:
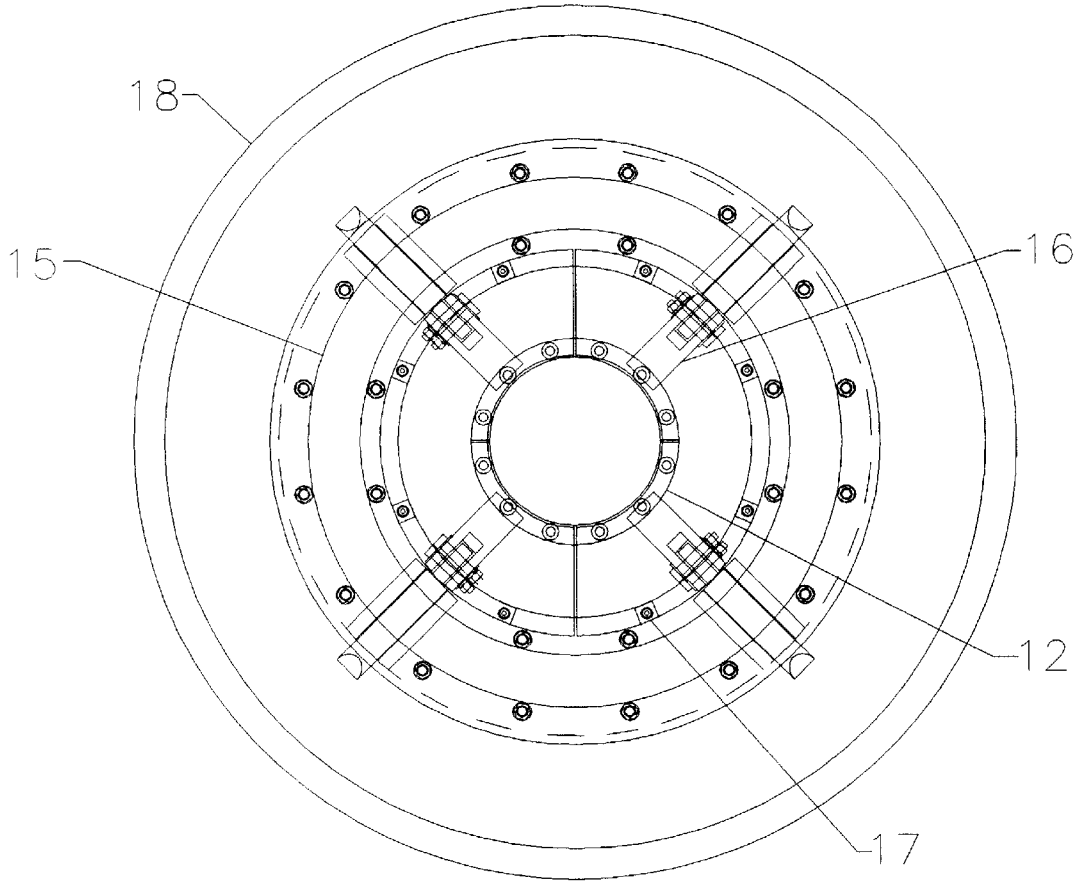
FIG. 5 is a top view of the drill stem guide of FIGS. 1 and 2.

In FIGS. 4 and 5, the drill stem guide 5 has been lowered sufficiently through opening 3 that it registers with closure housing 8, and is supported by the closure housing 8 and the centering device 18. In this position the support clamp 9 and collar 12 have also been lowered to permit latch actuator 16 to move downwardly, under influence of spring 13. As a consequence, the latch 14 has extended radially outward to engage latching ring 19.

As used herein the terms "registering" and "registers" merely denote alignment between components. The terms do not necessarily imply intentionally maneuvering or aligning, and therefore do not require any sort of a steering apparatus. In addition, "registering" and "registers" do not imply any sort of direct connection. Thus, in FIGS. 3 and 4 the drill stem guide 5 would still register with the closure housing 8 even if the closure housing contained a liner or gasket (not shown) which technically separated the drill stem guide 5 from the closure housing 8.

It should also be understood that because of the extremely broad definitions given to the terms "latch" and "catch" herein, the terms "extend" or "extending" must be construed with corresponding breadth. In particular the term "extended position" is merely used to distinguish "retracted position", and is not limited to extending radially outwardly. Thus, moving a latch tangentially to the outer surface of the drill guide from a retracted position, without any change in its radial extension, would is still considered to be "extending" the latch.

In FIG. 4 only one latch 14 is shown, although in FIG. 5 four latches are shown. In practice, any reasonable number of latches can be utilized, including as few as one or as many as four, five or more. Moreover, it is not necessary to have matching latches at opposite radial positions around the drill stem guide 5, or even for such latches to be evenly spaced about the drill stem guide.

The operation of the drill stem guide 5 is straightforward. During processing of the coke, the drill stem guide 5, drill stem 6 and drill bit 7 are all raised above the coke drum 1, and the cover 4 is secured to the rim of the upper opening 3 of the coke drum 1. Once the coking process is completed, the cover 4 is pulled off of the rim surrounding the opening 3, and moved out of the way. Movement of the cover is preferably accomplished hydraulically due to the size and weight of the cover 4, and most preferably comprises a boltless closure so that workers are not proximally involved in the potentially dangerous job of bolting and unbolting the cover bolts. Drill stem guide 5 is then lowered directly into the opening 3, bringing with it the drill stem 6 and the drill bit 7. As the drill stem guide 5 is lowered further, the centering device 18 contacts the closure housing 8, and the latches 14 are automatically triggered to project outwardly below the latching ring 19. To remove the drill stem guide 5 from the drum 1, the drill stem 6 is raised until the stem guide collar 12 contacts the stem guide latch actuators 16, thereby disengaging latches 14. The drill stem guide 5, drill stem 6 and drill bit 7 are then raised completely out of opening 3.

The term "automatically" is used herein to mean that the one event follows as a natural function of another event. For example, if a bolt is turned into a nut, the bolt will automatically be linearly translated with respect to the nut. No additional human intervention is required. In the preferred embodiment, the latching mechanism operates automatically as a function of raising and lowering the stem guide 5 with respect to the closure housing 8. This is advantageous for numerous reasons, one of the most important of which is the elimination of unnecessary human contact with the latching mechanism.

Thus, a drill stem guide device has been described that uses an internal latching mechanism which eliminates the need for direct operator contact with the coke drum and associated elements, while also eliminating dependence upon a flange around the opening. While specific embodiments and applications of this invention have been shown and described, it would be apparent to those skilled in the art that many more modifications are possible without departing from the inventive concepts herein. For example, other internal latching mechanisms could be employed, and the term internal latching mechanism should be interpreted herein to mean that engagement of the members participating in the latching occurs primarily inside the area defined by the external shape of the receiver. Thus, an external latch interlocking with an end flange as in the '799 patent constitutes an external locking mechanism rather than an internal latching mechanism because the latching mechanism occurs primarily or even exclusively at the external portion of the flange of the drum opening. On the other hand, a latching mechanism which latches onto the inside of an end flange, would fall within the scope of one or more of the below listed claims. The invention, therefore, is not to be restricted except in the spirit of the appended claims.

What is claimed is:

1. A method of decoking a coke drum, the method comprising:

providing a decoking drill and a drill guide which guides the drill into the coke drum, the drill guide having at least one latch;

providing the coke drum with a receiver adjacent a passageway into the coke drum, the receiver receiving the stem guide and further having at least one catch adjacent the passageway;

registering the drill guide into the receiver;

extending the latch into the passageway to engage the catch; and extending the drill into the coke drum.

2. The method of claim 1 wherein the step of extending the latch includes automatically extending the latch as the drill guide is maneuvered into the passageway.

3. The method of claim 2 further comprising the step of automatically retracting the latch as the drill guide is maneuvered out of the passage.

4. The method of claim 2 further comprising the step of spring loading the latch.

5. The method as in one of claims 1–4 wherein the receiver is not provided with an end flange.

6. The method as in one of claims 1–4 further comprising the step of providing the receiver with a boltless closure.

7. A coking drum adapted for use with a decoking drill guide; the adaptation comprising an upper opening fitted with a receiver having an internal latching mechanism for receiving and latching the decoking drill guide.

8. The coking drum of claim 7 wherein the latching mechanism includes a plurality of internal catches.

9. The coking drum of claim 7 wherein the latching mechanism includes a latching ring.

10. The coking drum of claim 8 wherein the drill guide includes a radially extending bolt, and at least one of the catches comprises a channel for receiving the bolt.

11. The coking drum as in one of claims 7–10 wherein the opening is not fitted with an end flange.

12. The coking drum as in one of claims 7–10 wherein the opening is closed with a boltless closure.

13. An improved drill stem guide for assisting in maintaining the position of a drill stem with respect to the inlet of a coking drum, the inlet defined by a rim having an inner diameter, the inlet further defining an opening of a passageway into the coking drum, the improvement comprising:

the drill stem guide including a plurality of outwardly extending members which are moveable between retracted and extended positions, at least one of the members extending no further outwardly in its extended position than the inner diameter of the rim;

the passageway having a latching mechanism; and the at least one of the members engaging the latching mechanism to assist in maintaining the position of the drill stem guide with respect to the coking drum.

14. The drill stem guide of claim 13 wherein the latching mechanism comprises a latching ring.

15. The drill stem guide of claim 13 wherein the latching mechanism comprises a plurality of channels.

* * * * *